US005374797A

United States Patent [19]

McMillan

[11] Patent Number: 5,374,797

[45] Date of Patent: Dec. 20, 1994

[54] SWITCH COVER WITH EXTENSION

[76] Inventor: John McMillan, 465 N. 45th, No. 405, Seattle, Wash. 98103

[21] Appl. No.: 210,051

[22] Filed: Mar. 16, 1994

[51] Int. Cl.[5] ..... H01H 3/20

[52] U.S. Cl. ..... 200/331; 200/338

[58] Field of Search ..... 200/331, 332, 338, 330; 74/503

[56] References Cited

U.S. PATENT DOCUMENTS

| | | | |
|---|---|---|---|
| 2,493,581 | 1/1950 | Hood . | |
| 2,582,379 | 1/1952 | Goldberg . | |
| 2,668,456 | 2/1954 | Meistrell | 74/503 |
| 2,919,334 | 12/1959 | Jones . | |
| 3,004,128 | 10/1961 | Mikolajeski . | |
| 3,077,789 | 2/1963 | De Lashmutt | 200/331 X |
| 3,188,439 | 6/1965 | Fullerton . | |
| 3,581,037 | 5/1971 | Schiffelbelm . | |
| 3,825,710 | 7/1974 | Roberts et al. . | |
| 3,839,615 | 10/1974 | Bradford | 200/331 |
| 3,892,935 | 7/1975 | Patterson | 200/331 |
| 3,916,134 | 10/1975 | Hansen | 200/331 |
| 4,105,884 | 8/1978 | Dansky | 200/331 |
| 4,221,946 | 9/1980 | Halstrum | 200/331 |
| 4,256,943 | 3/1981 | Whitlock | 200/331 |
| 4,295,026 | 10/1981 | Williams et al. | 200/331 |
| 4,454,401 | 6/1984 | Powis, Jr. | 200/331 |
| 4,590,345 | 5/1986 | Marshell | 200/331 |
| 4,705,924 | 11/1987 | Hevoyan | 200/331 |
| 4,743,724 | 5/1988 | Goodwin, Jr. | 200/331 |
| 4,771,145 | 9/1988 | Davis, Jr. | 200/331 |
| 4,870,232 | 9/1989 | Hoogland | 200/331 |
| 5,046,143 | 9/1991 | Uher | 200/331 |
| 5,055,645 | 10/1991 | Hull et al. | 200/331 |

FOREIGN PATENT DOCUMENTS

| | | | |
|---|---|---|---|
| 1242236 | 9/1988 | Canada | 200/331 |

*Primary Examiner*—Ernest G. Cusick

*Attorney, Agent, or Firm*—David P. Campbell

[57] ABSTRACT

A three-part light switch cover for enabling remote operation of a wall mounted toggle-type electrical switch comprising an elongated wall plate member adapted to enclose safely a sliding member that includes an upper end portion having an aperture adapted to receive a light switch lever and a lower end portion adapted so that the sliding member, formed at the lower end with an operating handle, is restricted to and accessible through the wall plate member. The wall plate member and sliding member are extended downward from an existing switch apparatus allowing a child or disabled person to operate the light switch from a height beneath the switch. Full use of the light switch is retained by the present invention for utilization in standard manner by means of an enlarged aperture in the wall plate member receiving the light switch lever. The wall plate member and sliding member are easily installable on a permanent, as well as temporary, basis.

5 Claims, 5 Drawing Sheets

SWITCH COVER WITH EXTENSION

BACKGROUND OF THE INVENTION

This invention relates to an improved light switch cover. More particularly, this invention relates to an improved light switch cover adapted to replace a standard light switch cover plate in order to allow a child or disabled person to operate the light switch from well below the standard height of the switch.

In health care centers, schools, and residences, it is desirable to provide children or disabled persons increased access to light switches. This is particularly important in cases where light switches have been installed at wall heights beyond the reach of such persons. A child, for example, may have learned to use bathroom facilities but may not yet be tall enough reach a bathroom light switch.

Light switches, especially those installed in structures built without consideration for the disabled, are generally installed at prescribed wall heights beyond the reach of some who need access to them. In many cases, the effort and cost of rewiring and reinstalling accessible light switches may be expensive.

In an attempt to remedy the foregoing situation, various adapter devices have been proposed. These prior art devices normally include a vertically reciprocable elongate extension piece that, at its upper end, engages the light switch, and at its lower end has a handle or grip for operating the extension piece to flip the switch lever, thus permitting remote operation of the switch lever. For example, U.S. Pat. No. 5,055,645, to Hull, U.S. Pat. No. 5,046,143, to Uher, and U.S. Pat. No. 4,743,724 to Goodwin disclose a switch operator comprised of a bracket secured to the wall switch and a downwardly disposed rigid or flexible extension, including a handle or knob, slidably held by the bracket. In these patents, means are not provided to enclose the working parts of the mechanism in order to increase durability and to prevent breakage. Such breakage could result in hazardous, unsafe conditions should the device be subjected to heavy use, especially by children.

Similar disclosures such as U.S. Pat. No. 4,295,026, by Williams et al., U.S. Pat. No. 2,919,334, by Jones, U.S. Pat. No. 2,668,456, by Meistrell, and U.S. Pat. No. 4,771,145, by Davis show switch operator housings enclosing much of the working mechanisms of the switch operators. However, the increased complexity of these devices increases the costs of production as well as the chances of mechanical failure when the device is subjected to heavy use. Each of the above disclosures lacks the simplicity of a vertically reciprocable elongate member offering a self-retaining control handle cost effectively integrated into the lower end of the member at a fixed level above the floor within reach of most users.

The Williams et al. disclosure shows the upper portion of the cover plate including an opening to receive the switch operating lever. This opening does not provide ample space for the user to access the switch operating lever, especially in retrofitting cases where the light switch has been installed in a recessed position in the wall. Other patents, such as Mikolajeski, U.S. Pat. No. 3,004,128, offer restricted access to the existing light switch operating lever.

U.S. Pat. No. 4,870,232, to Hoogland, and U.S. Pat. No. 4,743,724, to Goodwin, disclose apparatus that would, by their complexity, be difficult to install for the average user; or whose installations, as with Hoogland, require the need for drilling or screwing holes in the wall. The negative results of such activity become more apparent should the device be installed temporarily. Other prior art devices employing techniques generally similar to those discussed above are disclosed in U.S. Pat. No. 3,839,615, to Bradford; U.S. Pat. No. 2,493,581, to Hood; U.S. Pat. No. 3,188,439, to Fullerton; U.S. Pat. No. 2,582,379, to Goldberg; and U.S. Pat. No. 3,825,710, to Roberts et al.

Moreover, the foregoing patents disclose extension pieces that directly contact and engage the switch lever. It is believed that such a direct connection can create a noise problem when the switch assembly is operated, especially when the switch assembly is installed in rooms where quiet is of utmost importance. In addition, the direct engagement between the switch lever and the extension piece may also lead to damage of the switch lever.

Accordingly, there is a need for an improved replacement switch cover, such as the present invention, that differs from the previously-proposed devices discussed above in the provision of means allowing for optimal durability and safety through complete enclosure of the working parts of the device, allowing full use of the existing light switch in standard manner, by being relatively quiet in operation, and by consisting of one working part and, thus, being a device easy to install that safely and cost-effectively provides children and/or disabled persons access to a light switch.

DISCLOSURE OF THE INVENTION

Briefly described, the present invention comprises a wall switch extension for use in operating a wall-mounted toggle-type switch having an outwardly extending switch lever that toggles between at least up and down positions. The wall switch extension comprises an elongated enclosure plate having an aperture sufficiently large to receive both the switch lever and an operator's finger for flipping the switch lever between its up and down positions. The enclosure plate also includes a screw hole for receiving a screw that secures the elongated enclosure plate to the wall-mounted toggle-type switch, and a second handle aperture. The enclosure plate also includes a front plate portion and a sidewall portion extending from the perimeter of the front plate portion and defining an elongated recess enclosure. The wall switch extension also includes an elongated slide member narrow in profile for positioning in the elongated recess enclosure formed by the enclosure plate. The elongated slide member includes an upper end with an aperture sized to receive closely the switch lever and a lower end with an outwardly extending handle spaced from the aperture in the upper end of the slide member a distance so that the handle can extend through the handle aperture in the enclosure plate when the wall switch extension is assembled and the switch lever protrudes through the aperture in the upper end of the slide member. The wall switch extension also includes a gasket mounted to the slide member about the aperture in the upper end of the slide member. The gasket is adapted to fit between the slide member and the switch lever to dampen contact therebetween. Whereby the handle of the slide member can be moved up and down to slide the slide ,member longitudinally within the cavity of the enclosure plate and thereby toggling the switch lever between operable positions.

The sliding member includes a slot between its aperture that receives the switch lever and its handle, which slot is oriented longitudinally and receives the screw that secures the enclosure plate to the wall-mounted toggle-type switch, the slot allowing for longitudinal movement of the sliding member without interference from the screw.

The enclosure plate includes a second screw hole for receiving a second screw for securing the enclosure plate to the wall-mounted toggle-type switch. This allows for installation of the wall plate extension with use of the standard screws provided for securing a standard cover plate to the wall switch.

The second screw hole is spaced from the aperture in the enclosure plate that receives the switch lever a distance sufficient to allow the sliding member to move longitudinally without contacting the second screw.

The gasket includes an aperture for receiving the switch lever, which aperture is smaller than the switch lever. The gasket has sufficient flexibility so that the edges of the gasket that define its aperture can be pressed by the switch lever into the sliding member aperture.

These and other advantages and features will become apparent from the following detailed description of the best mode for carrying out the invention and the accompanying drawings, and the claims, which are incorporated herein as part of the disclosure of the invention.

BRIEF DESCRIPTION OF THE DRAWINGS

In order to understand more fully the drawings used in the detailed description of the present invention, a brief description of each drawing is provided as follows.

BEST MODE FOR CARRYING OUT THE INVENTION

Figure 1:
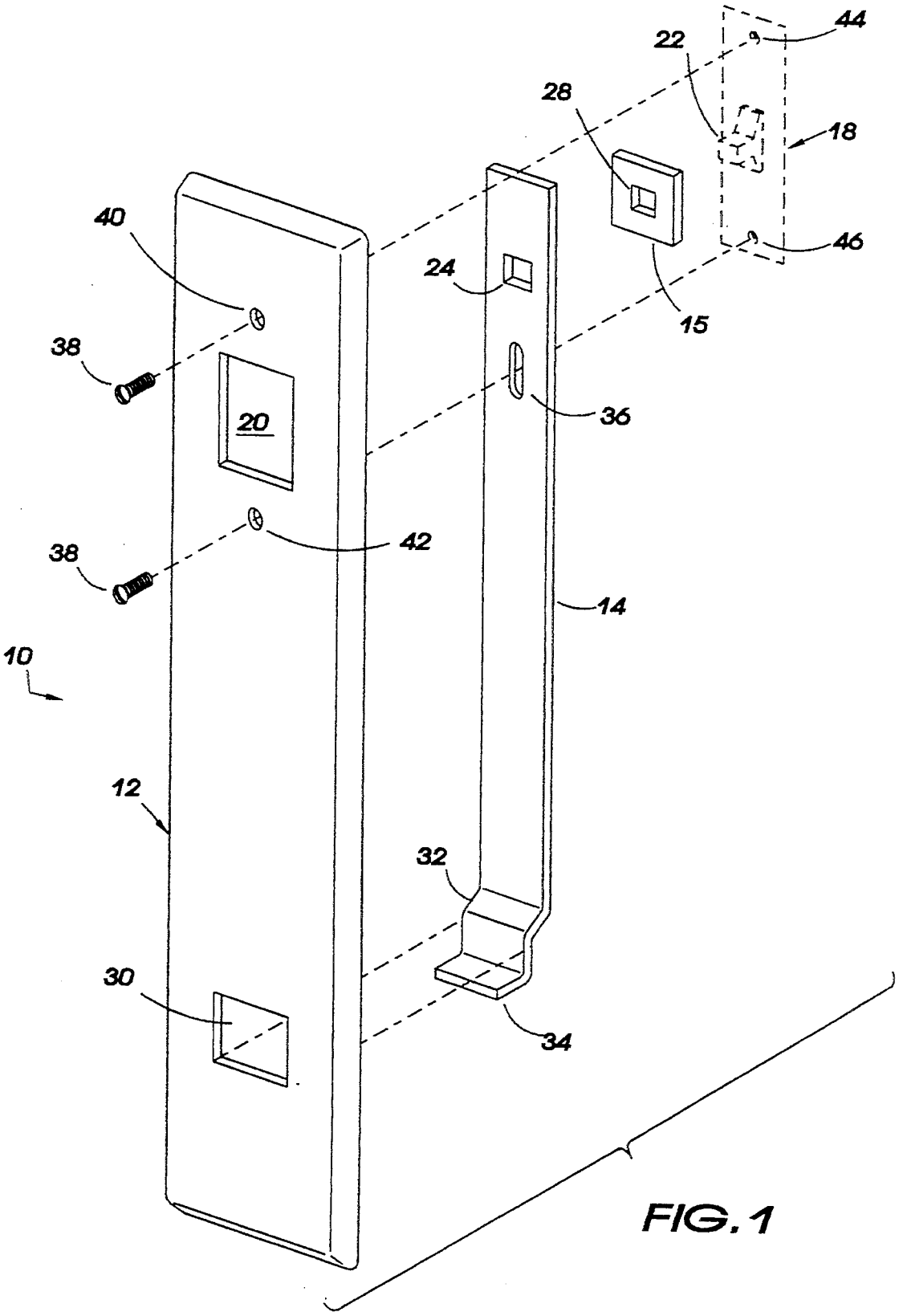
FIG. 1 is an exploded pictorial view of the wall switch extension assembly of the present invention.
Figure 2:
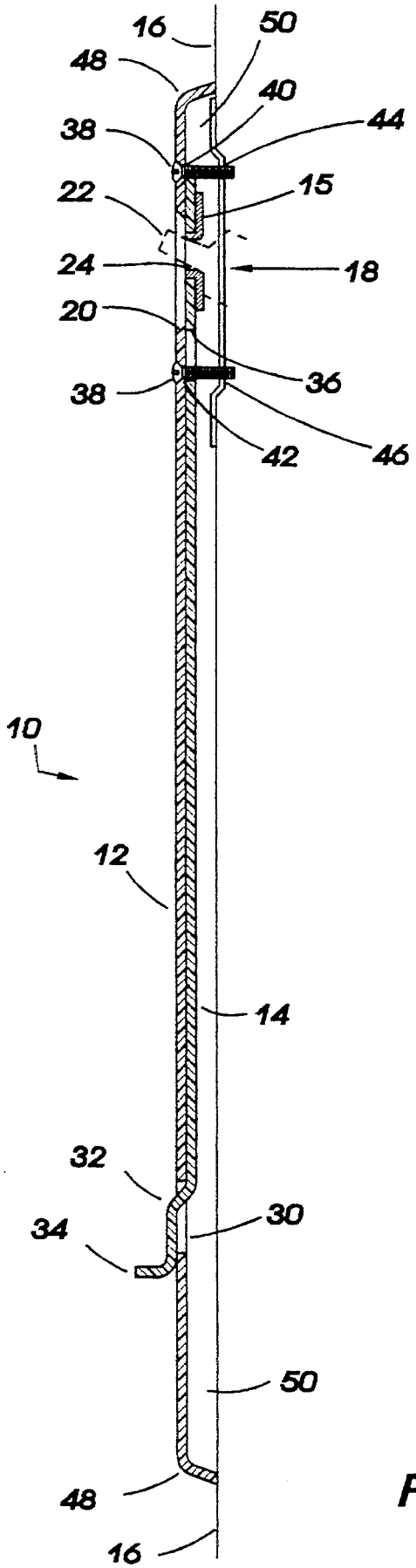
FIG. 2 is a sectional view of the wall switch extension assembly of FIG. 1, taken along the line 2—2 of FIG. 7, showing the gasket that is provided between the sliding member and the switch lever.
Figure 3:
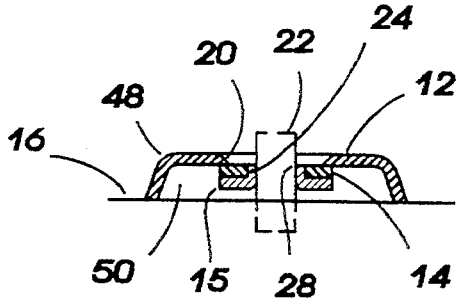
FIG. 3 is a sectional view of the wall switch extension assembly of FIG. 1, taken along the line 3—3 of FIG. 7, again detailing the gasket.

Referring to FIGS. 1–3, a light switch extension assembly 10 is shown comprising an enclosure plate member 12, a sliding member 14, and a gasket 15. The enclosure plate member 12 is mounted on a wall surface 16 (FIG. 2) overlying a toggle-type switch apparatus 18 (shown in phantom lines) mounted within wall surface 16. Enclosure plate member 12 includes an enlarged aperture 20 in the upper end portion of enclosure plate member 12. Aperture 20 is adapted to circumscribe a light switch lever 22 of switch apparatus 18 and to provide sufficient and adequate finger access to light switch lever 22.

The upper end of sliding member 14 includes an aperture 24 that also is adapted to circumscribe the light switch lever 22 and to allow adequate upward and downward longitudinal movement of the sliding member 14 to cause the upward or downward movement of light switch lever 22.

Figure 4:
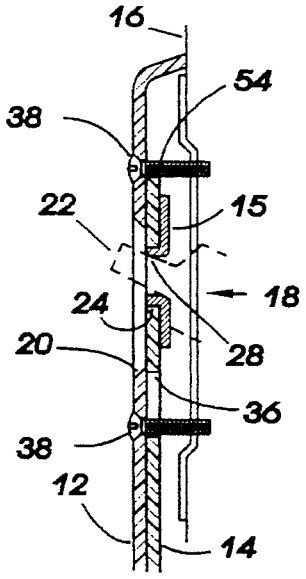
FIGS. 4–6 are partial sectional views of FIG. 2, showing the movement of the switch lever between its operable positions.
Figure 5:
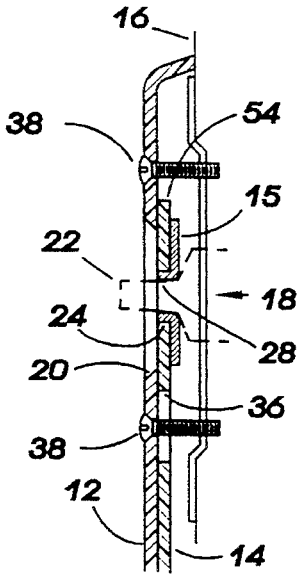
Figure 6:
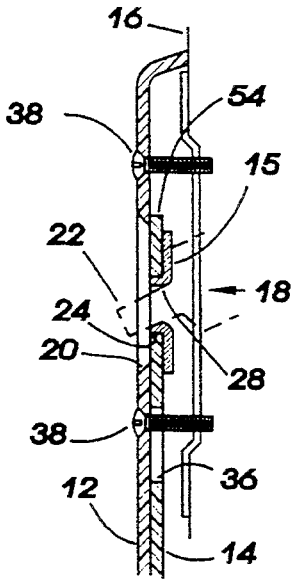
Figure 7:
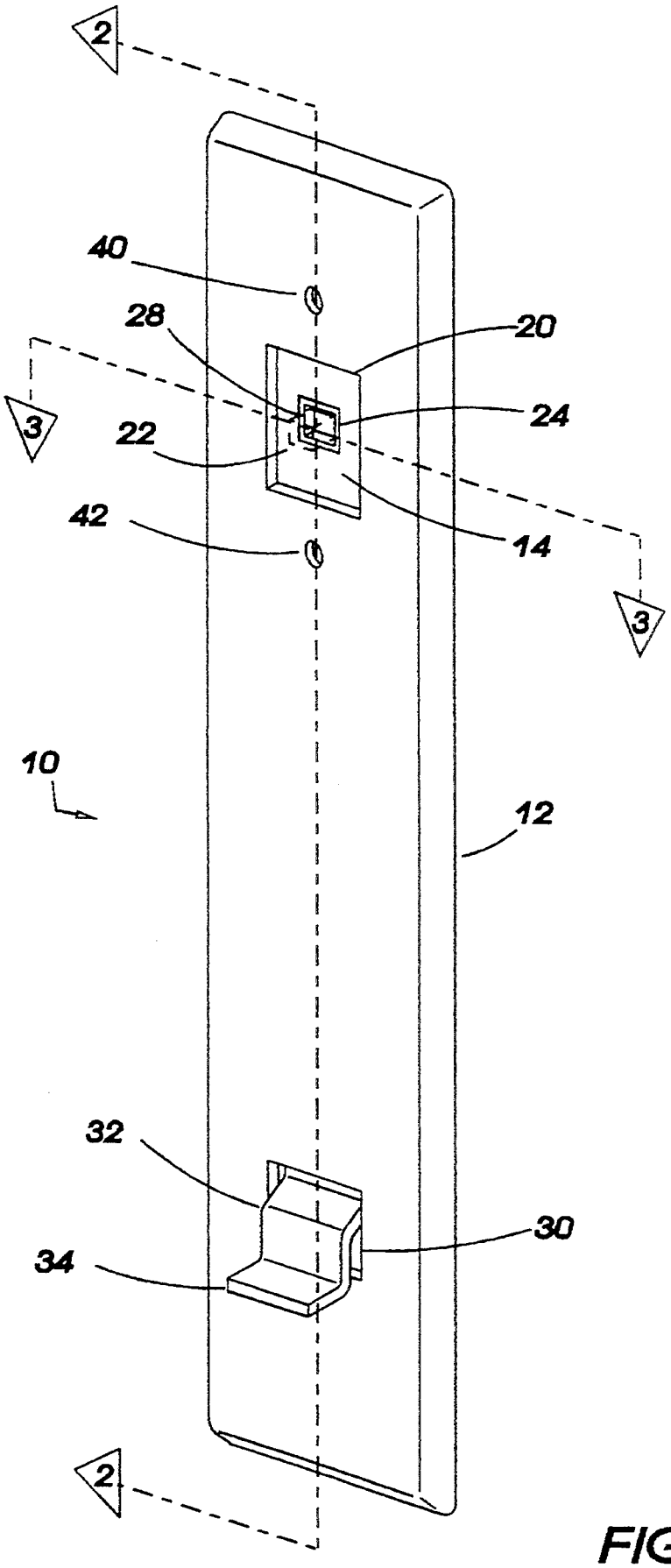
FIG. 7 is an assembled pictorial view of FIG. 1.

As shown in the partial sectional views of FIGS. 4–6, the gasket member 15 includes an aperture 28 that is smaller in size than the switch lever 22, yet is adapted to circumscribe the light switch lever 22 and that, when assembled between sliding member 14 and switch apparatus 18, provides a means to dampen the contact and play between sliding member 14 and light switch lever 22. The association of the gasket member aperture 24 in the upper end of sliding member 14, and the switch lever 22 of switch apparatus 18, is depicted in the "up" position in FIG. 4, the "neutral" position in FIG. 5, and the "down" position in FIG. 6.

As can be seen in FIGS. 4–6, aperture 20 of enclosure plate member 12 provides sufficient space between the switch lever 22 and the upper and lower edges of aperture 20 for a person to insert his finger in order to flip the switch lever 22. In some installations, the wall switch 18 is mounted in a recessed position relative to the wall surface. This diminishes the protrusion of switch lever 22 outwardly beyond the enclosure plate. As a result, without a large aperture 20 about switch lever 22, normal operation of switch lever 22 would be difficult.

Referring back to FIGS. 1–3, the lower end portion of enclosure plate member 12 includes an aperture 30 that adapted to circumscribe the curved portion 32 of lower end of sliding member 14 and to allow sufficient free movement of curved portion 32 of sliding member 14 across aperture 30. When sliding member 14, as shown in FIG. 2, is assembled and in the "up" position, this aperture 30 retains an operating handle 34, formed in the lower end of sliding member 14, accessible on the external side of enclosure plate member 12.

Sliding member 14 also includes an elongated aperture that is adapted to circumscribe a mounting screw or other fastener 38 in such manner that allows sufficient unobstructed sliding movement of sliding member 14, when extension assembly 10 is mounted to the switch apparatus 18.

Enclosure plate member 12 also includes apertures 40 and 42 that are formed above and below enlarged aperture 20, respectively. Once assembled, apertures 40 and 42 of enclosure plate member 12 are aligned, respectively, with threaded apertures 44 and 46 of switch apparatus 18, thereby permitting screws or other fasteners 38 to pass through the apertures and threadably engage with switch apparatus 18. Ease of installation of extension assembly 10, as shown in FIGS. 1 and 2, is thus promoted.

Sliding member 14 is enclosed within enclosure plate member 12 and securely restrained (in the assembled position, as shown) at its curved portion 32 by aperture 30 of enclosure plate member 12, and at its upper end both by a screw or other fastener 38 at the elongated aperture 36 and by the circumscription of aperture 24 around light switch lever 22.

Referring to FIGS. 2 and 3, enclosure plate member 12 includes a curved rim or sidewall 48 angled to form a recessed enclosure 50. Recess enclosure 50 houses sliding member 14, gasket 15, and switch lever 22 when mounted against the switch apparatus 18 and wall surface 16. Recessed enclosure 50 sufficiently encloses switch apparatus 18 and sliding member 14 while promoting a smooth movement of sliding member 14 against the inside of enclosure plate member 12.

Referring to the assembly 10 of FIGS. 1 and 2, it can be seen that a means is provided through which the upward or downward movement of operating handle 34 of sliding member 14 is transferred to the light switch lever 22, activating switch apparatus 18 and, thereby, providing operation from below of the otherwise inaccessible switch apparatus 18.

Referring to FIGS. 4–6, it can also be seen that as sliding member 14 moves up and down to flip the switch lever 22, the upper edge 54 of sliding member 14 travels between upper screw 38 and the upper edge of aperture 20. Thus, the upper edge 54 of sliding member 14 remains concealed.

Figure 8:
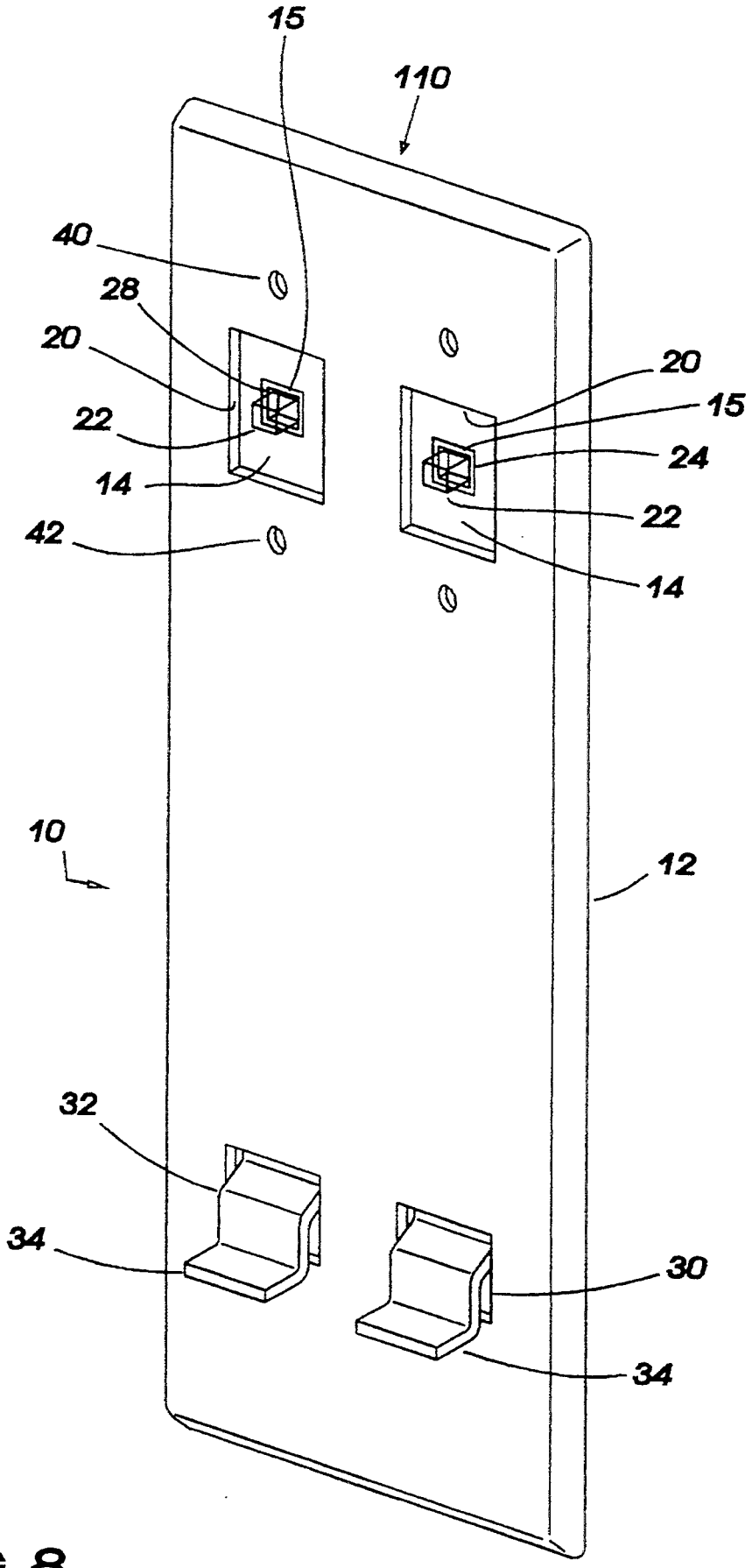
FIG. 8 is an assembled pictorial view of a second embodiment of the present invention.

FIG. 8 depicts a second embodiment of the light switch cover assembly of FIGS. 1–7, whereby a multiple switch apparatus is provided. The multiple light switch apparatus 110 includes two apertures 20 for receiving two switch levers 22. Two sliding members 14, including handles 34, individually operate the switch levers 22.

Preferably, the present invention is made of plastic using state-of-the-art vacuum forming or injection molding techniques well known to those skilled in the art. Gasket 15, preferably, is a single-sided adhesive mounting tape. Such a tape has sufficient flexibility to allow the switch lever 22 to press the inner edges of the gasket 15 into the aperture 24 of the sliding member 14, as shown in FIGS. 4–6. This ensures that the gasket 15 is positioned between the switch lever 22 and the sliding member 14.

The present invention has been described in terms of particular embodiments. Obviously, modifications and alterations to these embodiments will be apparent to those skilled in the art in view of this disclosure. It is, therefore, intended that all such equivalent modifications and variations fall within the spirit and scope of the present invention as claimed.

What is claimed is:

1. A wall switch extension for use in operating a wall-mounted toggle-type switch having an outwardly extending switch lever that toggles between at least up and down positions, the wall switch extension comprising:

an elongated enclosure plate having an aperture sufficiently large to receive both the switch lever and an operator's finger for flipping the switch lever between its and down positions, the enclosure plate also including a screw hole for receiving a screw that secures the elongated enclosure plate to the wall-mounted toggle-type switch, and a second handle aperture, the enclosure plate including a front plate portion and a sidewall portion extending from the perimeter of the front plate portion and defining an elongated recess enclosure, an elongated slide member narrow in profile for positioning in the elongated recess enclosure formed by the enclosure plate, the elongated slide member including an upper end with an aperture sized to receive closely the switch lever and a lower end with an outwardly extending handle spaced from the aperture in the upper end of the slide member a distance so that the handle can extend through the handle aperture in the enclosure plate when the wall switch extension is assembled and the switch lever protrudes through the aperture in the upper end of the slide member, and a gasket mounted to the slide member about the aperture in the upper end of the slide member, the gasket adapted to fit between the slide member and the switch lever to dampen contact therebetween, whereby the handle of the slide member can be moved up and down to slide the slide member longitudinally within the cavity of the enclosure plate and thereby toggling the switch lever between operable positions.

2. The wall switch extension of claim 1, wherein the sliding member includes a slot between its aperture that receives the switch lever and its handle, which slot is oriented longitudinally and receives the screw that secures the enclosure plate to the wall-mounted toggle-type switch, the slot allowing for longitudinal movement of the sliding member without interference from the screw.

3. The wall switch extension of claim 1, wherein the enclosure plate includes a second'screw hole for receiving a second screw for securing the enclosure plate to the wall-mounted toggle-type switch.

4. The wall switch extension of claim 3, wherein the second screw hole is spaced from the aperture in the enclosure plate that receives the switch lever a distance sufficient to allow the sliding member to move longitudinally without contacting the second screw.

5. The wall switch extension of claim 1, wherein the gasket include an aperture for receiving the switch lever, which aperture is smaller than the switch lever, and wherein the gasket has sufficient flexibility so that the edges of the gasket that define its aperture can be pressed by the switch lever into the sliding member aperture.

* * * * *

UNITED STATES PATENT AND TRADEMARK OFFICE

CERTIFICATE OF CORRECTION

PATENT NO. : 5,374,797

DATED : December 20, 1994

INVENTOR(S) : John McMillan

It is certified that error appears in the above-identified patent and that said Letters Patent are hereby corrected as shown below:

On the cover, under Section [56], "References Cited", "Dansky" should be -- Damsky --.

Column 2, line 68, ",member" should be -- member --.

Column 4, line 11, "member aperture" should be -- member 15, aperture --.

Column 4, line 29, insert -- is -- before "adapted".

Column 4, lines 37 and 38, "aperture" should be -- aperture 36 --.

Claim 1, column 5, line 47, after "its", insert -- up --.

Claim 3, column 6, line 35, "second'screw" should be -- second screw --.

Signed and Sealed this

Eighteenth Day of April, 1995

Bruce Lehman

*Attest:*

BRUCE LEHMAN

*Commissioner of Patents and Trademarks*

*Attesting Officer*